US005310014A

United States Patent [19]

Mueller

[11] Patent Number: 5,310,014

[45] Date of Patent: May 10, 1994

[54] WATER WELL DRILLING ACCESSORY, MOUNTABLE ON CABLE TOOL WATER WELL DRILLING MACHINERY, TO PROVIDE FOR THE SIMULTANEOUS DRIVING OF WATER WELL CASING PIPE SECTIONS, WHILE CONCURRENTLY UNDERTAKING DRILLING OPERATIONS

[76] Inventor: Harlan F. Mueller, P.O. Box 366, Duvall, Wash. 98019

[21] Appl. No.: 40,461

[22] Filed: Apr. 1, 1993

[51] Int. Cl.[5] ..... E21B 7/00

[52] U.S. Cl. ..... 175/171

[58] Field of Search ..... 175/135, 170, 171, 173, 175/189

[56] References Cited

U.S. PATENT DOCUMENTS

| | | | |
|---|---|---|---|
| 3,117,635 | 1/1964 | Deerkoski | 175/135 |
| 4,144,942 | 3/1979 | Abe et al. | 175/171 X |
| 4,232,752 | 11/1980 | Hauk et al. | 175/135 |
| 4,522,273 | 6/1985 | Larson | 175/135 |
| 4,585,080 | 4/1986 | Bender | 175/170 |
| 4,671,365 | 6/1987 | Back et al. | 175/170 X |
| 5,082,068 | 1/1992 | Cornell | 173/22 |

*Primary Examiner*—Thuy M. Bui

*Attorney, Agent, or Firm*—Roy E. Mattern, Jr.

[57] ABSTRACT

When using cable tool water well drilling machinery, referred to as a spudder, during drilling operations, the simultaneous operation of this water well drilling accessory is undertaken periodically, to drive water well casing pipe sections down below ground level. The basic component of this accessory, in a selective number of components, is a reciprocally guided hammer-head-ram integrally formed with both an axially aligned cylindrical chamber having a bottom entry to pass down over the top of the uppermost water well casing pipe section and slidably continue on down to surround a top portion of this pipe section, and another in line axially aligned cylindrical chamber having a bottom entry that will not pass over the top of the uppermost water well casing pipe section, but will allow passing of a drill bit and an overall drill string, other debris removing cylindrical units, such as a bailer, and their respective supporting and operating cables; and also there is an axially aligned impact transferring shoulder structure located where these two in line axially aligned cylindrical chambers meet one another, and this basic component is selectably joined with others: an interconnecting subassembly; a supporting and operating cable subassembly, inclusive of a cable path changing mechanism; and power source to operate the supporting and operating cable subassembly inclusive of operating the cable path changing mechanism, which in turn causes the up and down movements of the reciprocally guided hammer-head-ram, which then is driving water well casing pipe sections.

20 Claims, 4 Drawing Sheets

WATER WELL DRILLING ACCESSORY, MOUNTABLE ON CABLE TOOL WATER WELL DRILLING MACHINERY, TO PROVIDE FOR THE SIMULTANEOUS DRIVING OF WATER WELL CASING PIPE SECTIONS, WHILE CONCURRENTLY UNDERTAKING DRILLING OPERATIONS

BACKGROUND

When cable tool water well drilling machinery, often referred to as a spudder, has been used in the past and also currently, after impact drilling operations have been undertaken for a while, they are stopped. Then a large heavy two piece drive clamp is initially clamped in place about a drill stem at the drive clamp receiving planar structures thereof, and the two pieces thereof are tightened together by using their large and heavy bolt and nut fasteners, turned by using a wrench. Also a heavy protective drive head is positioned over the end of the water well casing pipe section. Thereafter, the overall drill string with the drive clamp is raised up and dropped several times to drive the water well casing pipe sections farther into the ground, as the drive clamp impacts the protective drive head. After the completion of this sequence of driving impacts, the drive clamp is loosened and cleared, and the protective drive head is removed and replaced, whenever another water well casing pipe section is added. Thereafter, after this considerable delay, the impact drilling operations are continued. The physical efforts involved in the placement and removal of the drive clamp assembly, and in this repeated tightening and loosening of the drive clamp, and in the placement and removal of the protective drive head, are very strenuously undertaken and become very tiring during a working day.

This interruption of the drilling operations to drive more portions of the water well casing pipe sections down below ground level occurs many times, when a water well is being installed by using cable tool water well drilling machinery. The successful operation of this machinery entirely relies on the vertical movements of the various tools to be used, as these tools are raised, lowered, and/or dropped by using cables manipulated upon the operation of this cable tool water well drilling machinery. The inherent twisting and untwisting of the cable provides the rotative force, which combines with the impacting force, occurring upon the free dropping of the drill string, to make the drill bit effective in drilling the well.

It is believed this interruption of the drilling operations, when cable tool water well drilling machinery is being utilized to drill a well, has always occurred. There has been no water well drilling accessory previously available for use to simultaneously drive water well casing pipe sections, while the cable tool drilling machinery continues to operate to drill the well. As a consequence, this is one of the important reasons why many persons drilling wells have discontinued using cable tool water well drilling machinery, which they often refer to as a spudder.

They are instead using water well drilling machinery, which they refer to as mud rotary, which include power units that directly rotate the drill bit, drill, and drill string, instead of the impacting force operations undertaken when operating cable tool water well drilling machinery. When this more expensive machinery is operating, there are accessories or direct components thereof which are used to drive the water well casing pipe sections more conveniently and often simultaneously, while the drilling continues.

In reference to this mud rotary equipment, in 1980, Messrs. Hank and Kirkpatrick in U.S. Pat. No. 4,232,752, illustrated and described their method and apparatus for driving pipe. The Abstract reads as follows:

> "A casing hammer for driving casing while drilling a water well comprises a housing having an annular pneumatic chamber with a relatively lightweight, shortstroke annular piston. The piston is reciprocally driven at a high rate to provide a large number of light blows of controllable energy upon an annular anvil that seals one end of the chamber. Percussive blows upon the anvil are transmitted through a drive head and adapter to the upper end of the pipe to be driven. The hammer is suspended from a rotary drive head that operates a hollow drill string extending downwardly through the hammer and through the casing driven thereby."

Also, in 1985, Leslie N. Larson, in U.S. Pat. No. 4,522,273, disclosed his drilling rig. He used rotary power to rotate his drill bit, drill rod, and overall drill string. Also, at the same time he used a ram or top head to impart a linear axial force to the overall drill string, to create an overall effective drilling operation.

Then without interfering with this drilling operation, he operated a percussion assembly mounted on the drilling tower to apply a cyclical percussive force to the end of a well casing pipe extending out of the drilled hole. This percussion assembly had a piston, which was rapidly reciprocated, by utilizing high pressure air or another appropriate fluid. The piston was positioned at a location spaced laterally from the axis of the drill rod and it reciprocated cyclically in a direction parallel to the axis of the drill rod.

A lever and a transmission element transferred this percussive force from the lateral location thereof to the end of the well casing. The lever was designed to always accommodate the run of the drill rod, which continued rotating during the drilling operations, which were simultaneously continued, when the well casing was being driven into the ground.

Although water well drilling machinery, such as disclosed in these U.S. Pat. Nos. 4,232,752 and 4,522,273, which supplied a rotary power to the overall drill string, were also provided with components which could be operated simultaneously to impact well casing sections, driving them farther into the ground, it is understood there has not been such like purpose components or accessories provided to be used, when cable tool water well drilling machinery is being operated to drill a water well.

SUMMARY

In respect to water well drilling, previously, when cable tool water well drilling machinery, referred to as a spudder, was utilized, there would be time consuming shut downs of the drilling operations to undertake the strenuous physical effort and time consuming steps at the start and finish of the overall drilling operation of hand installing and removing the large and heavy two piece drive clamps, with their large and heavy bolt and nut fasteners, and also the hand installing and removal of the large and heavy protective drive head. Thereafter many steps occurred many times during the drilling of each well, at the respective start and completion of each driving period, during which the water well casing pipe section or sections were driven farther into the ground. At each driving time, the two piece drive clamp had to be tightened in place, and later loosened and cleared, and also the drive head had to be removed and then replaced when each new section of the water well casing pipe was added. Thereafter, the interrupted well drilling continued on in stages, until reaching the specified depth of the water well.

Now, this water well drilling accessory is available for mounting on cable tool drilling machinery, to provide for the simultaneous driving of well casing pipe sections, while concurrently undertaking drilling operations. No strenuous physical effort is involved and no drilling time is lost, as was true previously, when drilling stopped for the tightening and loosening of the drive clamp and the periodic installation and removal of the protective drive head, when a new water well casing pipe section was added. Therefore, when this water well drilling accessory is installed on cable tool water well drilling machinery, the resulting combined machinery is very effectively used. The operations of this so called spudder equipment, also having this accessory, in respect to less time consumed, and less effort involved, and also in respect to a lower financial investment, makes the utilization of cable tool water well drilling machinery more competitive in comparing it with operating rotary head water well drilling machinery, often referred to as mud rotary equipment. Or stated in another way, the so called jar head equipment, i.e. the spudder equipment, will be more favorably considered, when comparing it to swivel head equipment, i.e. the mud rotary equipment.

The water well drilling accessory is readily mounted on cable tool water well drilling machinery without any major interference with the existing arrangement of the components thereof. The basic component of this water well drilling accessory, available in a selective number of sizes, is a reciprocally guided hammer-head-ram integrally formed with: an axially aligned cylindrical chamber having a bottom entry to pass down over the top of the uppermost water well casing pipe section and to slidably continue on down to surround a top portion of this pipe section; another in line axially aligned chamber having a bottom entry that will not pass over the top of the uppermost water well casing pipe section, but will allow the passing of a drill bit, and an overall drill string thereof, other debris removing cylindrical units, such as a baler, and all their respective supporting and operating cables; and also an axially aligned impact transferring shoulder structure, located where these two in line axially aligned chambers meet one another.

This basic component, i.e. the reciprocally guided hammer-head-ram, is selectably joined with other components, such as: an interconnecting subassembly; a supporting and operating cable subassembly, which includes a cable path changing means; and power means to operate the supporting and operating cable subassembly, which includes the cable path changing means, thereby causing up and down movements of the reciprocally guided hammer-head-ram to drive the water well casing pipes below ground level, while the drilling operations continue on without interruption.

DRAWINGS

A preferred embodiment of the water well drilling accessory, in respect to the mounting thereof on cable tool water well drilling machinery, is illustrated in the drawings, wherein.

Figure 3:
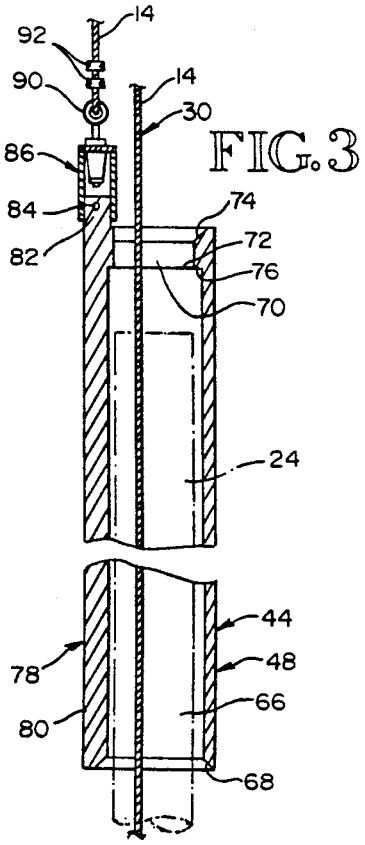
Figure 4:
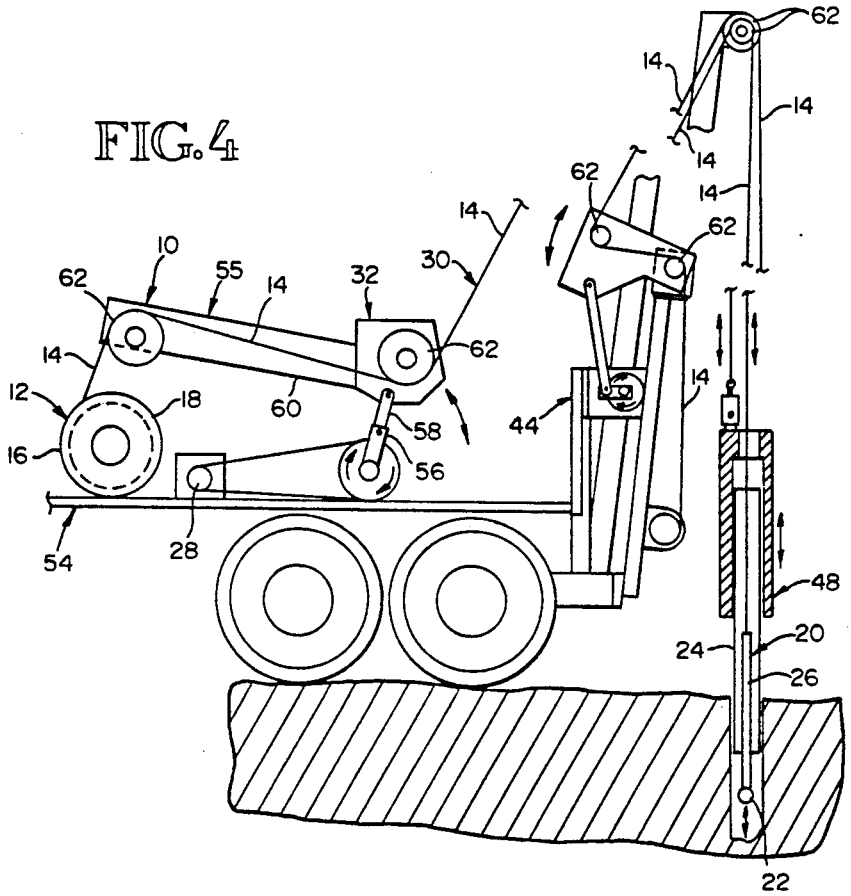
Figure 5:
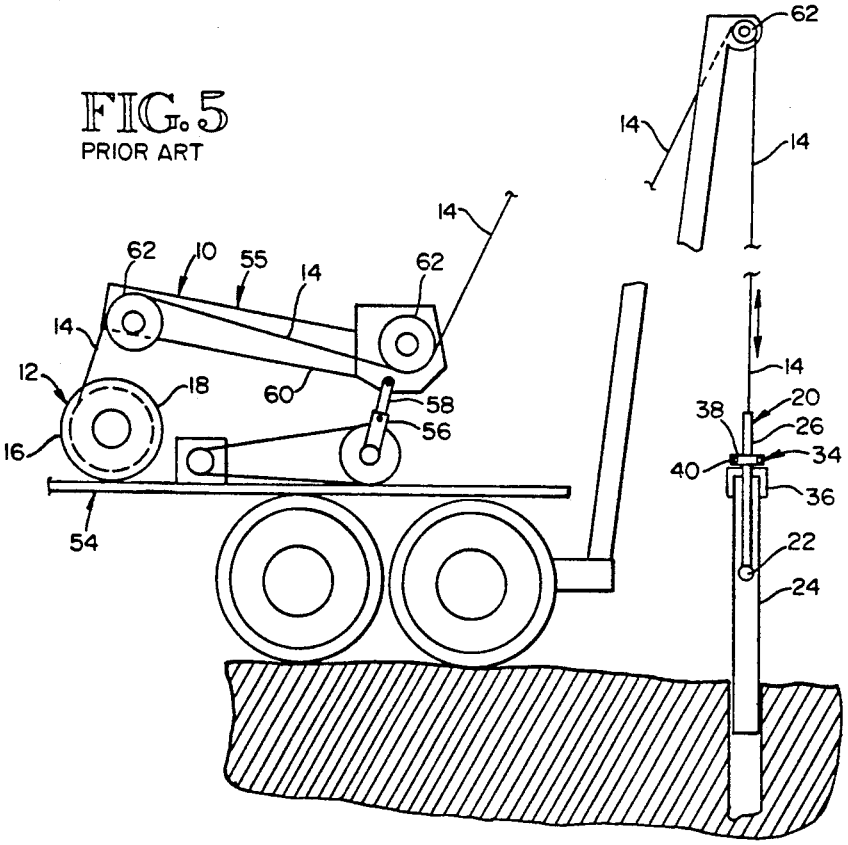
FIG. 5 PRIOR ART
Figure 6:
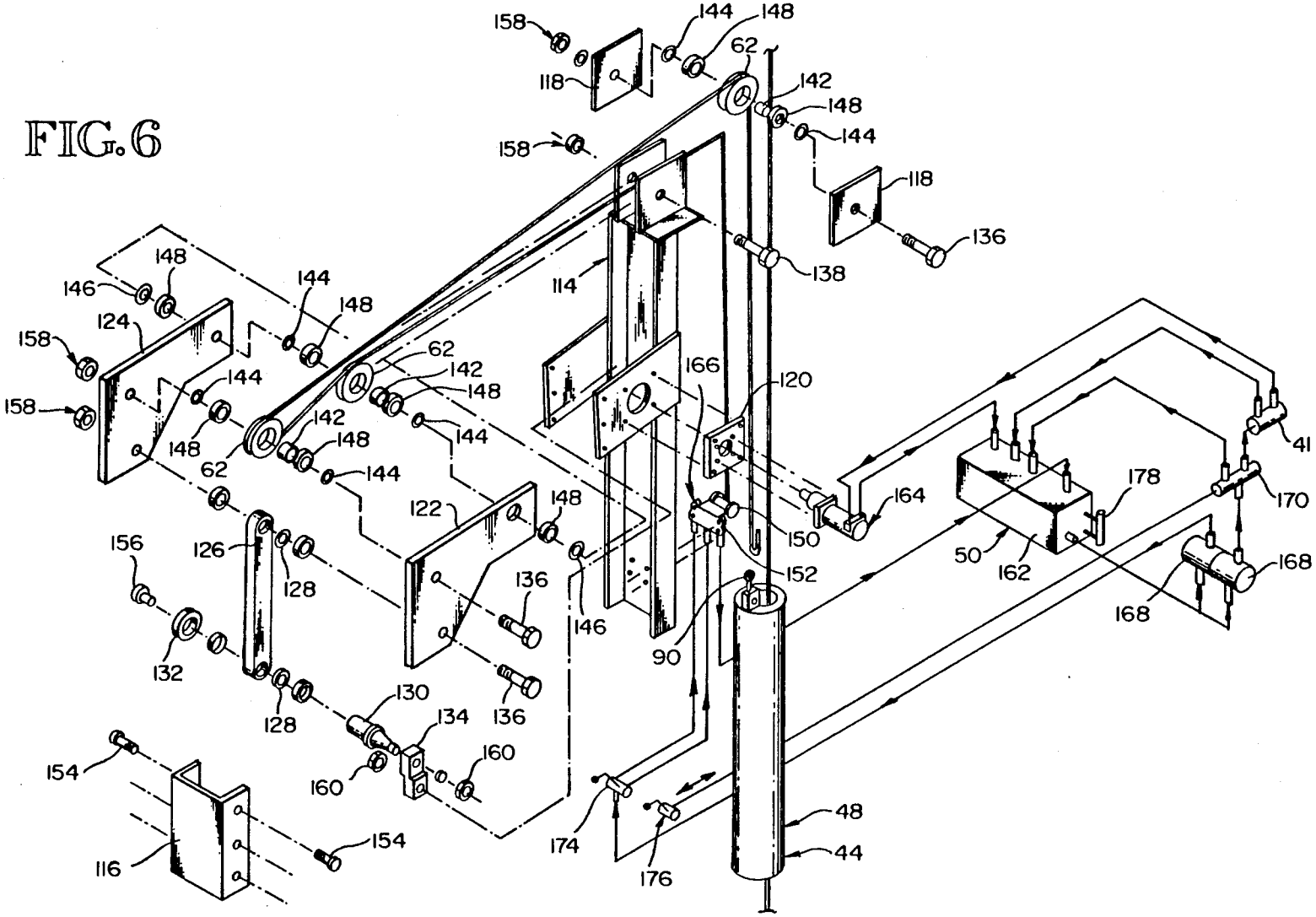
Figure 7:
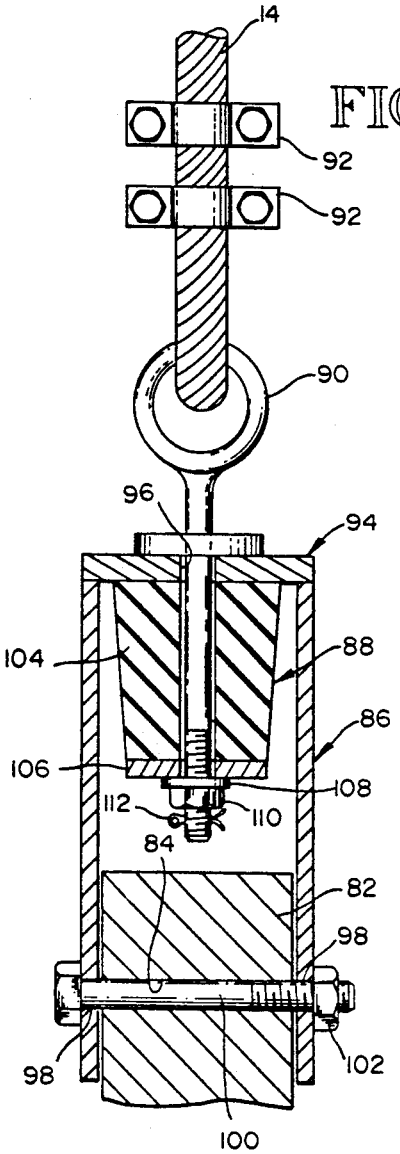
Figure 8:
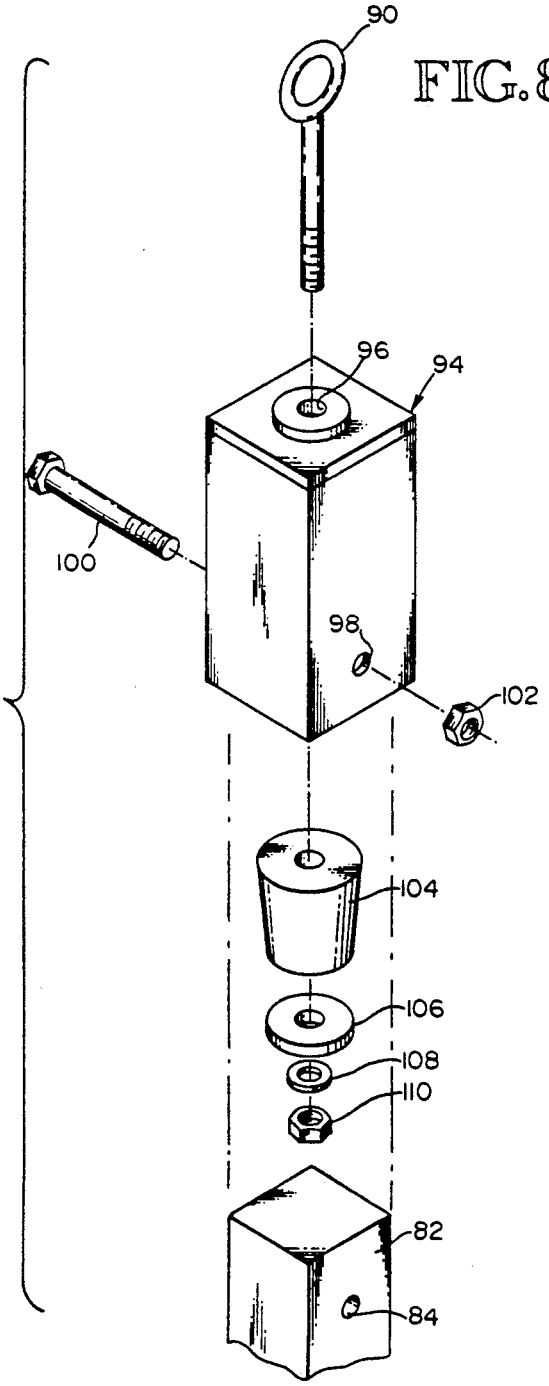

FIG. 3 is a partial sectional view of the reciprocally guided hammer-head-ram, supported by its cable, while the cable supporting the drill string passes through, and the water well casing pipe section, shown in phantom lines, over which the reciprocally guided hammer-head-ram reciprocally moves, during the impacting force operations undertaken to drive the water well casing pipe section downwardly into the ground;

FIG. 4 is a partial schematic elevational view, with portions broken away, and motion arrows used, to illustrate how the truck mounted cable tool water well drilling machinery, including the water well drilling accessory, are operating to continuously drill the well, while simultaneously the water well drilling accessory is driving the water well casing pipe section into the ground;

FIG. 5 is a partial schematic elevational view, noted as prior art, to illustrate how, previously, without having the water well drilling accessory, the drilling operations were stopped many times during the well drilling period, and then each time, after placement of the large heavy drive clamp about the drill stem and also the placement of the protective drive ring over the upper end of the water well casing pipe section, the repeated operation was undertaken to drive the water well casing pipe section a bit farther into the ground;

FIG. 6 is an exploded, schematic, perspective view of a preferred embodiment of the water well drilling accessory, before installation, which includes a power take off shaft driven hydraulic pump and related hydraulic line circuits, hydraulic reservoir, hydraulic motor, and hydraulic controls, all interrelated to: a cable reel, cable path changing components, a cable, mounting frame components, and various bearings, bushings, washers, and fastening components;

FIG. 7 is a partial cross-sectional view of the top portion of the reciprocally guided hammer-head-ram illustrating how it is connected to its operating cable by utilizing a connecting cap assembly, which in turn uses a bumper, thereby creating an overall shock absorbing connection subassembly; and FIG. 8 is an exploded view of some of the components of the overall shock absorbing connection subassembly shown in FIG. 7.

DESCRIPTION OF THE PREFERRED EMBODIMENT

The Basic Prior Art Cable Tool Water Well Drilling Machinery Often Referred to as a Spudder For over fifty years cable tool well drilling procedures and cable tool water well drilling machinery 10, often referred to as a spudder, have been utilized as schematically shown in FIG. 5. Basically no major changes have been made.

The cable tool water well drilling machinery 10, also often referred to as the cable tool rig, comprises:

A large bull reel 12 onto which the drilling cable 14 is spooled. There are two sides or reeling portions of this large bull reel 12. One side is known as the reserve cable side 16 and the other side is known as the drilling cable side 18. The cable 14 is initially spooled or wound on the reserve cable side 16. Upon the commencement of the well drilling, a small length of the cable is moved, spooled, or wound on the drilling cable side 18 of this large bull reel 12.

Where the water well hole is to be started, a section of water well casing pipe 24 is positioned, using another operating cable, not shown, and a sand reel, not shown. This section of pipe 24 has a larger diameter than the diameter of any component of the drilling string 20, such as the drill bit 22, or the drill stem 26. Also this diameter of the section of pipe 24 accommodates the passage of all of the other tools that may be used during the drilling operations and other operations, such as, bailers, sockets, drilling jars, fishing jars, casing cutters, casing perforators, sinker bars, etc.

After this placement of the first section of the water well casing pipe 24, the drilling string 20 is lowered into place to position the drill bit 22. Water is then added. Then a drilling motion or operation is started upon operation of a motor 28, and the resulting movement of an operating cable subassembly 30, inclusive of a cable path changing means 32, as illustrated in FIG. 5, in reference to this prior art machinery and operations.

When this small length of cable 14 has been effectively and alternately rewound and then allowed to freely unwind, allowing the drilling string 20 to drop, and the drill bit 22 thereof, to also rotate, as the cable untwists, for an overall period of effective drilling time, then a hole is created which must be cleaned out. The drilling string 20 is pulled out by operating the bull reel 12. Thereafter, the sand reel, not shown, is operated so its operating cable, not shown, lowers a bailer, not shown, down into the hole to capture the pulverized earth portions and muddy water, and to thereafter raise the bailer and its contents out of the hole and away to a dumping locale.

This sequence of drilling periods followed by bailing, results in the waterwell casing pipe section or sections moving somewhat freely downwardly for a limited distance, but eventually this pipe section or pipe sections stop. Then a driving force must be created and effectively used to drive the pipe section or pipe sections well down to the bottom of the drilled and cleaned well hole.

As shown in FIG. 5, in respect to the prior art, a drive clamp subassembly 34 is secured to the squared portions of a drill stem 26. Then a drive head 36 is protectively placed over the upstanding end of the top water well casing pipe 24. Thereafter, the raising and dropping of the drilling string 20 causes the drive clamp 38 of the drive clamp subassembly 34 to impact the drive head 36, and thereby drive the water well casing pipe 24 or pipes 24 farther into the ground, until the current bottom of the drilled and clean well hole is reached. If this current bottom is not at the specified depth of the water well, then the entire sequence of the drilling, bailing, and driving operations must be again undertaken. The sequence is repeated several times during the drilling of a water well.

During each time driving operations are needed to impact the water well casing pipe 24 or pipes 24, the drilling operations must be stopped, while the drive clamp subassembly 34 is tightened, then used, and thereafter loosened. The drive clamp subassembly 34 includes the drive clamp 38 made of two opposed sections and two sets 40 of bolt and nut fasteners. The drive clamp subassembly 34, depending on its size, weighs in the range of one hundred pounds to four hundred pounds. A thirty six inch pipe wrench, or equivalent tool, not shown, is used in tightening and loosening the two sets 40 of bolt and nut fasteners, of the drive clamp assembly 34.

Because of the weights of these drive clamp subassemblies 34 and the sets 40 of bolt and nut fasteners, and moreover because of the often higher locations of the squared portions of a drill stem 26, when the top of the water well casing pipe 24 is still well above ground level, tremendous physical efforts are involved in both the placement and removal of the drive clamp subassembly 34 and the periodic tightening and loosening of the bolt and nut fasteners during the drilling of the water well. This time of tremendous physical effort occurs several times during each one of the days of drilling a water well. This combination of stopping the drilling procedures, of tightening the drive clamp subassembly 34, of impacting the pipe section or pipe sections, and of loosening the drive clamp subassembly 34, and the periodic placement and removal of the drive head 36, resulted in many persons, who drill water wells, to stop using cable tool drilling machinery, and to start using rotary powered drilling machinery, i.e. to switch from the spudder machinery to the mud rotary machinery.

Figure 1:
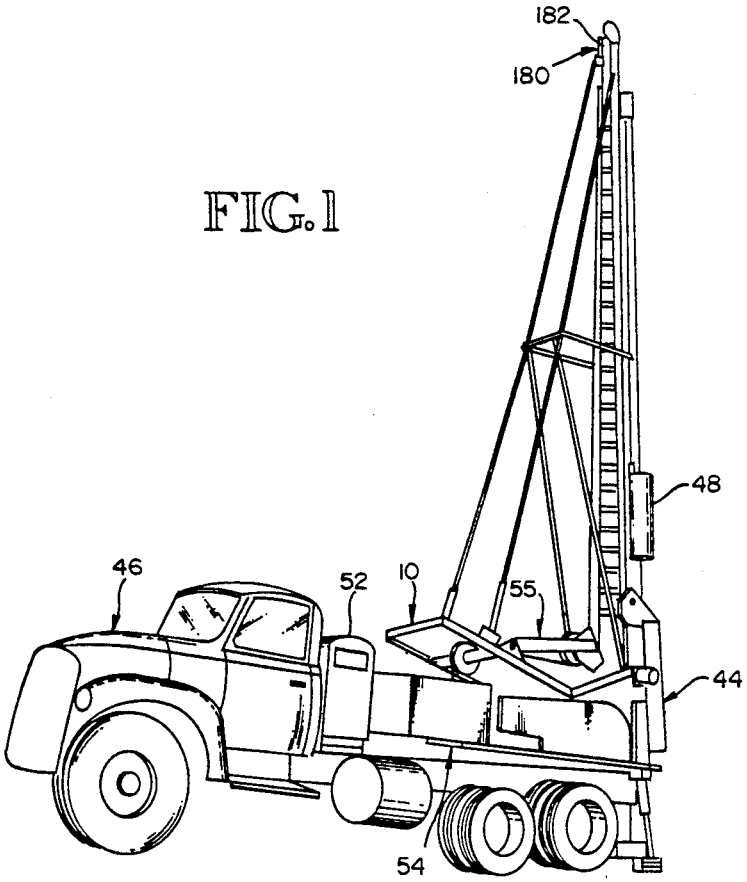
FIG. 1 is a perspective view of truck mounted cable tool water well drilling machinery, including the water well drilling accessory, in position at a water well drilling location.
Figure 2:
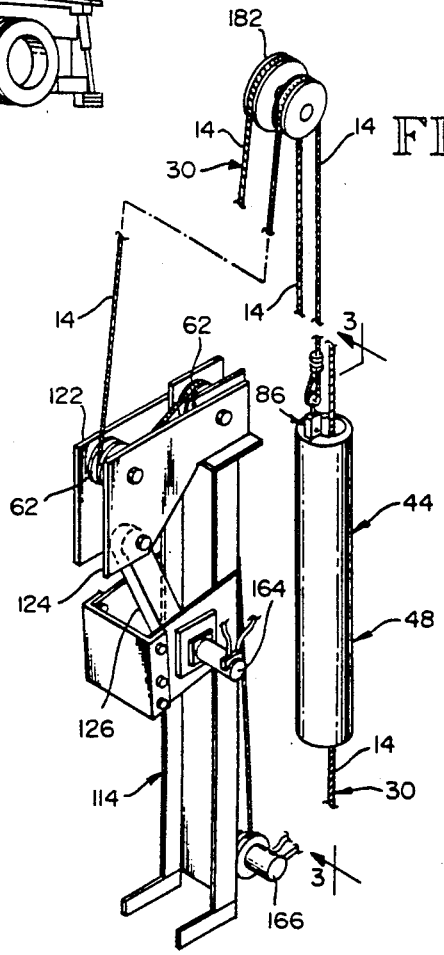
FIG. 2 is a partial perspective view, showing the basic component called a reciprocally guided hammer-head-ram, supported by its cable, and portions of the operating cable subassembly, which includes a cable path changing means.

This Water Well Drilling Accessory Mounts on the Cable Tool Water Well Drilling Machinery to Eliminate the Need to Stop the Drilling to Install the Drive Clamp and the Drive Head, and in so Doing Eliminates the Tremendous Physical Efforts That Were Involved and Saves Time in Drilling a Water Well A water well drilling accessory 44 is shown in FIGS. 1 and 4 mounted on cable tool water well drilling machinery 10, in turn mounted on a truck 46, without interfering with the already installed components thereof. An exploded view of the preferred embodiment is illustrated in FIG. 6. The key components are shown in FIG. 2, and the basic component, is illustrated in FIG. 3, which is a reciprocally guided hammer-head-ram 48.

By installing this water well drilling accessory 44, the drilling operations can continue, while the water well pipe casing sections are being impacted downwardly into the drilled hole. Also all the tremendous physical efforts are eliminated because the drive clamp subassembly 34 and the drive head 36 no longer are removably installed. Therefore, those persons still using cable tool drilling machinery 10, if they install this water well drilling accessory 44, will gain by reducing the time they spend in drilling a water well, and by reducing the strenuous physical effort they expend in drilling a water well.

The illustrated preferred embodiment of this water well drilling accessory 44 is preferably powered and operated by a hydraulic system 50. It receives its initial power, preferably, via a power take off shaft, not shown, of the main gas engine 52 of the cable tool drilling machinery 10.

The overall mechanical and structural assembly 54 of this water well drilling accessory 44, particularly illustrated in the exploded view of FIG. 6, is essentially a smaller scale assembly of the essential mechanical motion components of the cable tool drilling machinery 10, centering on the pivotal moving components 55 referred to as crank 56, pitman arm 58, spudding beam 60, and in reference to their respective sheaves 62. The prime numerals are noted in FIGS. 1, 4, and 5, to designate these components on the cable tool drilling machinery 10, and these same numerals, without the prime notation are used in FIGS. 1, 2, 4 and 6 to designate these components on the water well drilling accessory 44.

These like functioning pivotal moving components 55', when powered on cable tool drilling machine 10, change the path of the cable 14', resulting in the raising of drilling string 20 followed by the free fall of the drilling string 20. This repeated operation of this cable path changing means 32' is undertaken during the drilling operations.

These like functioning pivotal moving components 55, when powered on the water well drilling accessory 44, change the path of the cable 14, resulting in the raising of the basic component, which is referred to as the reciprocally guided hammer-head-ram 48, followed by its free fall. This repeated operation of this cable path changing means 32 is undertaken during the operations when a water well casing pipe 24 is being driven downwardly into the ground, while simultaneously the drilling operations are being undertaken. These simultaneous, time saving and strenuous labor saving, operations are illustrated in FIG. 4, especially in reference to observing the motion designating arrows, pertaining to the respective raising and dropping of the drill string 20, and the reciprocally guided hammer-head-ram 48.

The Basic Component, i.e. the Reciprocally Guided Hammer-Head-Ram, of This Water Well Drilling Accessory In FIG. 3, the basic component 44 of this water well drilling accessory 44, is illustrated. It is referred to as the reciprocally guided hammer-head-ram 44. It is integrally formed with both: a lower axially aligned cylindrical chamber 66 having a beveled bottom entry 68 sized to pass down over the top of the uppermost water well casing pipe section 24, and slidably continue on down to surround the top portion of this pipe section 24; and a higher and smaller in line axially aligned cylindrical chamber 70 having a bottom entry 72, that will not pass over the top of the uppermost water well casing pipe section 24. However, this bottom entry 72 and the top beveled entry 74 are large enough to allow the passing of: a drill bit 22; the overall drilling string 20 thereof; other debris removing cylindrical units, such as a bailer, not shown, and their respective supporting and operating cables.

Also there is an axially aligned impact transferring shoulder structure 76, integrally located where these two in line axially aligned cylindrical chambers meet one another. Preferably, the extra mass portion 78 of this reciprocally guided hammer-head-ram 48, which is needed to assist in creating the impacting force, is distributed to one side 80 in relation to where the supporting cable 14 is also to be attached at this one side 80.

An upstanding integral connecting pin receiving structure 82, having a horizontally positioned through-hole 84 is formed at this one side 80 extending upwardly beyond this top beveled entry 74 of this reciprocally guided hammer-head-ram 48. Preferably, as shown in FIGS. 3, 7, and 8, the supporting and operating cable 28 is indirectly connected to this upstanding integral connecting pin receiving structure 82, via the horizontally positioned through-hole 84. As particularly illustrated in FIGS. 7 and 8, a hammer connecting cap assembly 86, in turn having an overall shock absorbing connection subassembly 88, is utilized. The specific components of this hammer connecting cap assembly 86, and the overall shock absorbing are: the hammer cap eye bolt 90, through which the supporting cable 14 is passed and returned and then secured to itself by cable nut fasteners 92, as shown in FIGS. 3 and 7; the hammer connecting cap 94 having a vertical aligned hole 96 at the top to receive the hammer cap eye bolt 90 and having a pair of aligned spaced horizontal holes 98 near the bottom thereof, to receive the horizontal interconnecting structurally loaded headed pin 100 and its retainer 102; the rubber bumper 104, serving as the shock absorber, which is placed about the hammer cap eye bolt 90, after its entry into the hammer connecting cap 94, and captured in place by using a positioning-backing plate 106, serving like an oversized washer, then a lock washer 108, a nut 110, and a retainer 112 to keep the nut 10 in place.

This overall arrangement of the distribution of the extra mass portion 78, and the locations of where the connecting cap assembly 86 and the upstanding integral connecting pin receiving structure 82 are located for their connection to the supporting cable 14, well clear of the many passing through operating components, results in the very desirable result that the reciprocal guided hammer-head-ram 48, when lifted to be positioned in its operating positions, substantially always remains essentially upright, thereby avoiding any troublesome interference with any of the passing through operating components and their supported cable.

Preferably the rubber bumper 104, serving as the shock absorber is utilized. However, if wanted, the supporting cable 14 could be secured directly to the connecting pin receiving structure 82. Such direct securement increases the noise level and causes great wear of the connecting components.

More Detailed Information Concerning the Specific Parts of This Water Well Drilling Accessory The overall operation of this water well drilling accessory 44 is illustrated in FIGS. 1 through 4, and the specific relative positioning arrangement of essentially all of the components thereof is presented further in FIG. 6. The following listing of the names and part numbers of many of the parts shown in the exploded view of FIG. 6 will assist in one's understanding of more of the details of this preferred embodiment of this water well drilling accessory:

| NUMBER | NAME |
|---|---|
| 114 | Main frame weldment assembly |
| 116 | Weld mounting bracket lower |
| 118 | Weld mounting brackets, upper |
| 120 | Motor mounting spacer |
| 122 | Spudding beam, left hand |
| 124 | Spudding beam, right hand |
| 126 | Pitman arm |
| 128 | Pitman arm spacers |
| 130 | Crank pin |
| 132 | Crank pin cap |
| 134 | Crank |
| 136 | Spud pins |
| 138 | Pivot pin for spud |

-continued

| NUMBER | NAME |
|---|---|
| 62 | Sheaves |
| 48 | Reciprocally guided hammer-head-ram |
| 142 | Sheave spacers inside |
| 144 | Sheave spacers middle |
| 146 | Sheave spacers outside |
| 148 | Bearings |
| 150 | Winch cable reel |
| 14 | Cables |
| 152 | Hydraulic motor for winch |
| 94 | Hammer connecting cap assembly |
| 154 | ½" I.D. bolt and lock |
| 156 | ⅝" I.D. bolt and lock |
| 158 | 1½" - 12 NF nut and lock |
| 160 | 1⅛" - 18 NF nut and lock |
| 162 | Hydraulic oil reservoir |
| 164 | Hydraulic motor for driving the pitman arm |
| 166 | Hydraulic winch |
| 168 | Two hydraulic pumps |
| 170 | Diverter valve of hydraulic oil flow |
| 172 | Flow divider of hydraulic oil flow |
| 174 | Operating lever of hydraulic system |
| 176 | Operating lever and control cable for diverter valve |
| 178 | Hydraulic oil reservoir sight glass re oil level |

By Having the Operational Use of This Water Well Drilling Accessory Other Operational Advantages are Realized, for Example, in Respect to: Dislodging Rocks Which Roll up in the Space Between Pulling Tools or Other Tools and the Inside of the Water Well Casing Pipe Sections: Setting a Well Screen: and Clearing Away Water Well Casing Pipe Sections Tending to go in the Wrong Direction, so Thereafter Blasting Away Rocks by Using Dynamite May be Undertaken to Clear the Way For Continued Straight Away Well Drilling Previously, when cable tool drilling machinery 10 was operated, without having the operational advantages of the installation of this water well drilling accessory 44, when rocks tended and did roll up, while drilling operations were underway, to stick and to lodge in the space between the drilling tools or other tools, the drilling operations were stopped. Then a two hundred pound bumper bar of the prior art, not shown, was attached to the cable, referred to as the sand line, and was used to bump the tools free. At a two hundred foot depth, for example, it often took approximately fifteen minutes to loosen the jammed, stuck tools. Such jamming and sticking of tools may occur in the range, for example, of twenty to fifty times when the drilling of the well requires going through certain rock formations.

In contrast, by using this water well drilling accessory 44, and impacting the water well casing pipe current top section 24, via the reciprocally guided hammer-head-ram 48, the rocks are dislodged sufficiently, so the tools are freed. Nine out of ten times, when using this water well drilling accessory 44, the tools will be freed after three to five impacts, which takes three to five seconds to accomplish. Overall critical drilling time is saved, and the strenuous work of installing and using the two hundred pound bumper bar is avoided.

Previously, when cable tool drilling machinery 10 was operated, without having the operational advantages of the installation of this water well drilling accessory 44, when a well screen was set to be at the bottom of a well, the normal procedure was to load or to fill the hole with water. Thereafter the sand in the well was pumped even with the bottom of the lowest water well casing pipe 24. During this pumping of the sand, water was added to keep the sand from coming back into the well hole. Then the well screen was dropped to the bottom. Checking on its position followed to make sure the well screen remained at the bottom. Then with casing blocks attached to the top of the top water well casing pipe section 24, and using a choker, the drilling tools were utilized to bump against the many installed casing pipe sections 24. The overall casing pipe then started to edge its way up to reach the well screen location at the bottom of the well. Unfortunately, however, many times the sand will unwantedly come in at the bottom and push the well screen up out of position, sometimes up in a range of five to fifteen feet. If this happened, the water screen had to be recovered, i.e. fished out, and the steps of setting the well screen had to be started all over again.

In contrast, when the water well drilling accessory 44 is available having been installed with the cable tool drilling machine 10, the drilling tools, weighing approximately eleven hundred pounds, are set or positioned on top of the well screen. Thereafter the water well drilling accessory 44 is operated and the reciprocally guided hammer-head-ran 48 impacts or bumps the top of the top water well casing pipe 24 to vibrate the entire water well casing pipe back up to reach and properly expose the well screen at the bottom of the well hole. To get this known proper position, a painted mark is made above on the drilling cable when the drilling tools are at the bottom of the well hole. Thereafter, the distance the entire water well casing pipe is raised is relative to the positioning of this painted mark on the drilling cable. This procedure eliminates any guess work on when to stop raising the entire water well casing pipe.

Previously, when cable tool drilling machinery 10 was operated, without having the optional advantages of the installation of this water well drilling accessory 44, when rocks were encountered during the drilling operations, the lower and leading water well casing pipe section 24, and perhaps a following one, would unwantedly go off in a wrong direction following the drilled hole in the rocks. This slanted or crooked positioning of the water well casing pipe section 24 was not wanted. Therefore the overall water well casing pipe has to be raised by using hydraulic jacks requiring time and strenuous efforts. When this overall water well casing pipe was raised clear, the dynamite was used to blast the rocks out of the way or so they could be cleared. This procedure often took a half a day's time.

In contrast, by using this water well drilling accessory 44, and impacting the water well casing pipe current top section 24, via the reciprocally guided hammer-head-ram 48, the overall water well casing pipe is vibrated and raised up in minutes to become well clear of the follow on blasting procedures, that are undertaken to get the rocks out of the way for the subsequent drilling operations.

Brief Summary of Many of the Advantages of Installing and Operating This Water Well Drilling Accessory in Conjunction With the Operation of a Cable Tool Drilling Machine This water well drilling accessory 44 may be preassembled in a compact unit for handling, storing, and shipping. Upon its arrival for installation with a cable tool drilling machine 10, the mounting thereof on the frame of the cable tool drilling machine 10, is comparatively simple. Then the cables 14 and sheaves 62 are arranged conveniently with respect to derrick 180, and the crown 182 thereof, of the cable tool drilling machine 10. The hydraulic pumps 168 are conveniently mounted to be powered, via the power take off shaft of the main engine 52 of the cable tool drilling machine 10. Thereafter, the lever hydraulic controls are conveniently located.

Then when the cable tool drilling machine 10 is being operated to drill the well, this water well drilling accessory 44 is at selected times simultaneously, i.e. concurrently, operated to drive the water well casing pipe sections 24 downwardly into the drilled well hole, without any time delay, and without the need for tremendous and/or strenuous physical effort by the person or persons drilling the water well.

Also this water well drilling accessory 44 is successfully utilized, saving time and eliminating the need for tremendous and/or strenuous physical effort:

when rocks are jammed or stuck between the well drilling tools and the interior sides of the water well casing pipe sections 24 and they must be freed;

when setting a well screen at the bottom of the drilled well, where the bottom end of the bottom water well casing 24 is to be located; and when the overall, then in place, water well casing pipe, must be raised clear, when drilling operations have been unwantedly stopped, so that follow on dynamite blasting of rock can be undertaken to break up the rock that has been encountered. Thereafter the follow on drilling will create a drilled hole that remains aligned with the previously aligned portions of the well hole, then being lined by the advancing and lowering water well casing pipe sections 24, which are being secured together to make the overall water well casing pipe.

I claim:

1. A water well drilling accessory, mountable on cable tool drilling machinery, in turn mounted on a vehicle, and when so mounted operated to drive water well casing pipe sections into the ground without interfering with the prior and continuing placement and operation of the drill bit and the overall drill string thereof, and thereby at times operating at the same time the water well drill is operating, comprising:

a. a reciprocally guided hammer-head-ram integrally formed to provide:

i. an axially aligned cylindrical chamber having a bottom entry to pass down over the top of the then uppermost water well casing pipe section and slidably continue on down to preferably surround at least a substantial length of the then guiding and aligning top portion of the exterior of this water well casing pipe section;

ii. an axially aligned cylindrical chamber arranged concentrically above the axially aligned chamber that slides down the top portion of the uppermost water well casing pipe section, and having a bottom entry that will not pass over the top of the uppermost water well casing pipe section, but will allow the passing of the drill bit and the overall drill string thereof, other debris removing cylindrical units, and their respective supporting and operating cables;

iii. an axially aligned impact transferring shoulder structure having a larger diameter matching the diameter of the axially aligned cylindrical chamber which receives the top portion of a water well casing pipe section, and a smaller diameter matching the diameter of the axially aligned cylindrical chamber which does not receive this top portion of the water well casing pipe section;

iv. a top portion utilized during the securement of this reciprocally guided hammer-head-ram to a supporting and operating cable.

2. A water well drilling accessory mountable on cable tool drilling machinery, as claimed in claim 1, wherein the reciprocally guided hammer-head-ram is also integrally formed to provide a heavy mass portion located eccentrically alongside the respective axially aligned cylindrical chamber.

3. A water well drilling accessory mountable on cable tool drilling machinery, as claimed in claim 2, wherein the top portion utilized during the securement of this reciprocally guided hammer-head-ram is also the top portion of the heavy mass portion.

4. A water well drilling accessory mountable on cable tool drilling machinery, as claimed in claim 3, comprising in addition, an interconnecting subassembly, comprising in turn:

a. an eyelet structure to receive a portion of a supporting and operating cable;

b. a connecting pin receiving structure securely associated with this eyelet structure;

c. a connecting pin receiving structure securely associated with the top portion utilized during the securement of this reciprocally guided hammer-head-ram; and d. a connecting pin passable through these respective connecting pin receiving structures.

5. A water well drilling accessory mountable on cable tool drilling machinery, as claimed in claim 4, wherein the interconnecting subassembly has, in addition, a shock absorbing subassembly operable between the eyelet structure and the respective connecting pin receiving structures.

6. A water well drilling accessory mountable on cable tool drilling machinery, as claimed in claim 4, comprising in addition, a supporting and operating cable subassembly, comprising:

a. a substantial length of cable;

b. cable securement means to secure one cable end to the interconnecting subassembly in respect to the eyelet structure thereof;

c. cable winch means to actively reel out or wind in portions of this substantial length of cable;

d. a cable path changing means having in turn:

i. a first sheave means to guide cable portions and mounted as high as possible on cable tool drilling machinery and positioned so the cable depending from this sheave means will be substantially parallel to a respective supporting and operating cable associated with the overall drill string;

ii. a third sheave means to guide cable portions and mounted to be moved on an arc pathway having a constant radius with respect to the second sheave means and the center thereof, at the same time to be moved alternatively away from the first sheave and then toward the first sheave.

7. A water well drilling accessory mountable on cable tool drilling machinery, as claimed in claim 6, wherein the supporting and operating cable subassembly comprises, in addition:

an upright frame subassembly to be mounted on the cable tool drilling machinery and supporting the first, second, and third sheave means.

8. A water well drilling accessory mountable on cable tool drilling machinery, as claimed in claim 7, wherein the upright frame subassembly has a pivotal arm rotatably supported to the top thereof and located by the second sheave means, using one end thereof, and the other end of this pivotal arm rotatably supports the third sheave means.

9. A water well drilling accessory mountable on cable tool drilling machinery, as claimed in claim 8, having in addition an actuating means subassembly for moving the pivotal arm and thereby moving the third sheave means, whereby the cable path changing means becomes operational, and the third sheave means thereof during alternative movements, when moving away from the first sheave means, movably guides the cable, so the reciprocally guided hammer-head-ram is raised, and then subsequently when moving toward the first sheave means, movably guides the cable, so the reciprocally guided hammer-head-ram is quickly lowered to impact the top water well casing pipe section, thereby driving all the casing pipe sections farther below ground level, and during these alternative movements, the reciprocally guided hammer-head-ram always remains with a portion of the axially aligned cylindrical chamber and the bottom entry thereof positioned over the top of the then uppermost water well casing pipe section.

10. A water well drilling accessory mountable on cable tool drilling machinery, as claimed in claim 9, wherein the actuating means subassembly, which causes the operation of the cable path changing means, by moving the pivotal arm, which is also called the spudding beam, comprises:

a. driving motor having a power shaft;

b. a crank mounted on the power shaft; and c. another pivotal arm, which is also called a pitman arm, is pivotally mounted at one end thereof, on the crank, at one end thereof, and is pivotally mounted at the other end thereof to the spudding beam.

11. A water well drilling accessory mounted on cable tool drilling machinery, as claimed in claim 10, wherein the actuating means subassembly, also has a driving motor mounting frame to support the driving motor, and to be connected to the upright frame subassembly.

12. A water well drilling accessory mountable on cable tool drilling machinery, as claimed in claim 11, wherein the driving motor of the actuating means subassembly is a hydraulic motor, and wherein the cable winch means of the supporting and operating cable subassembly has a hydraulic motor.

13. A water well drilling accessory mountable on cable tool drilling machinery, as claimed in claim 12, having in addition a complete hydraulic control system to be utilized in operating both the hydraulic driving motor and the hydraulic cable winch motor, comprising: a hydraulic oil reservoir, hydraulic pump, hydraulic diverter valve, hydraulic lever valve, hydraulic flow divider, and hydraulic pipes to direct the hydraulic fluid flows throughout this complete hydraulic control system.

14. A water well drilling accessory mountable on cable tool drilling machinery, as claimed in claim 13, having in addition a coupling means for connecting the hydraulic pump of the hydraulic system to a power take off shaft of an engine of cable tool drilling machinery.

15. A water well drilling accessory mountable on cable tool drilling machinery, as claimed in claim 14, which is mounted on cable tool drilling machinery, thereby making a combination of them.

16. A water well drilling accessory, mountable on cable tool drilling machinery, in turn mounted on a vehicle, and when so mounted operated to drive water well casing pipe sections into the ground without interfering with the prior and continuing placement and operation of the drill bit and the overall drill string thereof, and thereby at times operating at the same time the water well drill is operating, comprising:

a. a reciprocally guided hammer-head-ram integrally formed to provide:

i. an axially aligned cylindrical chamber having a bottom entry to pass down over the top of the then uppermost water well casing pipe section and slidably continue on down to preferably surround at least a substantial length of the then guiding and aligning top portion of the exterior of this water well casing pipe section, and a top entry of the same size, as the cylindrical chamber inside diameter remains uniform;

ii. an axially aligned top impact transferring shoulder structure extending across the top of the axially aligned cylindrical chamber, and having an aligned passageway of a uniform smaller diameter than the diameter of the axially aligned cylindrical chamber so this aligned passageway will not receive the top portions of a water well casing pipe section;

iii. a top portion utilized during the securement of this reciprocally guided hammer-head-ram to a supporting and operating cable.

17. A water well drilling accessory mountable on cable tool drilling machinery, as claimed in claim 16, wherein the reciprocally guided hammer-head-ram is also integrally formed to provide a heavy mass portion located eccentrically alongside the respective axially aligned cylindrical chamber.

18. A water well drilling accessory mountable on cable tool drilling machinery, as claimed in claim 17, wherein the top portion utilized during the securement of this reciprocally guided hammer-head-ram is also the top portion of the heavy mass portion.

19. A water well drilling accessory mountable on cable tool drilling machinery, as claimed in claim 18, having a beveled structure surrounding the top entry of the smaller diameter aligned passageway of the axially aligned top impact transferring shoulder structure, which serves to guide the entering motions of all of the cable supported and operated tools, that are used when cable tool drilling machinery is being operated in drilling a water well.

20. A water well drilling accessory mountable on cable tool drilling machinery, as claimed in claim 19, having a beveled structure surrounding the bottom entry of the axially aligned cylindrical chamber of uniform diameter, which serves to guide the entering motions of all the cable supported and operated tools that are used when cable tool drilling machinery is being operated in drilling a water well.

* * * * *